US006188644B1

(12) United States Patent
Walsh et al.

(10) Patent No.: US 6,188,644 B1
(45) Date of Patent: Feb. 13, 2001

(54) PHOTON TRANSDUCER

(75) Inventors: Kenneth M. Walsh, Middletown; Lynn T. Antonelli, Cranston, both of RI (US)

(73) Assignee: The United States of America as represented by the Secretary of the Navy, Washington, DC (US)

( * ) Notice: Under 35 U.S.C. 154(b), the term of this patent shall be extended for 0 days.

(21) Appl. No.: 09/310,690

(22) Filed: May 10, 1999

(51) Int. Cl.[7] ..... H04R 1/44; H04R 23/00
(52) U.S. Cl. ..... 367/149
(58) Field of Search ..... 367/149; 73/514.26, 73/514.27, 514.29, 649, 653, 655, 657; 356/345

(56) References Cited

U.S. PATENT DOCUMENTS 4,446,543 * 5/1984 McLandrich et al. ..... 367/149
5,249,163 * 9/1993 Erikson ..... 367/149
5,311,485 * 5/1994 Kuzmenko et al. ..... 367/149
5,373,487 * 12/1994 Crawford et al. ..... 367/149
5,504,719 * 4/1996 Jacobs ..... 367/149

* cited by examiner

*Primary Examiner*—Ian J. Lobo
(74) *Attorney, Agent, or Firm*—Michael J. McGowan; Robert W. Gauthier; Prithvi C. Lall

(57) ABSTRACT

In accordance with the present invention, a photon transducer system is provided for obtaining information on acoustic signals within a fluid environment. The photon transducer system uses a laser-based Doppler interferometer located within a pressure release surface. The pressure release surface is formed by generating a gas pocket in the fluid, creating a boundary layer between the laser light source and the surrounding fluid. Laser light is reflected from the boundary and is detected by the interferometer to obtain the Doppler velocity of the pressure release surface. The pressure incident on the boundary can be determined from the measured velocity, providing information on the incident acoustic pressure.

18 Claims, 2 Drawing Sheets

PHOTON TRANSDUCER

The invention described herein may be manufactured and used by or for the Government of the United States of America for governmental purposes without the payment of any royalties thereon or therefore.

BACKGROUND OF THE INVENTION (1) Field of the Invention

The present invention relates generally to transducers used to convert an acoustic signal to an electrical signal, and more particularly to a transducer using scattered laser light reflections from a pressure release boundary between two mediums of different acoustic characteristic impedance.

(2) Description of the Prior Art

Traditional transducers rely on piezoelectric materials to convert acoustic signals in the form of pressure waves into electrical signals. More recently, research and development has been undertaken in the area of laser optic transducers, or hydrophones. As an example of such a device, U.S. Pat. No. 5,504,719 to Jacobs recites a laser beam which is focused upon a small volume of water in which natural light scattering matter is suspended and which matter vibrates in synchronism with any sonic waves present. The vibration produces a phase modulation of the scattered light which may be recovered by optical heterodyne and sensitive phase detection techniques. These laser transducers suffer in that the particles scatter the laser light in all directions, thus significantly reducing the amount of scattered light reflected back to the transducer and making detection of an acoustic signal more difficult. When the flow around the transducer is increased, additional noise components are introduced further complicating signal detection.

SUMMARY OF THE INVENTION

Accordingly, it is an object of the present invention to provide a laser based technique for detecting acoustic signals in a fluid such as in an underwater environment.

Another object of the present invention is to provide a laser based technique for detecting acoustic signals in a dynamic underwater environment.

Still another object of the present invention is to provide a laser based technique for detecting acoustic signals in an underwater environment which increases the amount of reflected light.

Other objects and advantages of the present invention will become more obvious hereinafter in the specification and drawings.

In accordance with the present invention, a laser-based Doppler interferometer system, or photon transducer system, is provided which interrogates a pressure release surface with a beam of coherent laser radiation. The pressure release surface is formed by generating a gas pocket in the fluid, creating a boundary layer between the laser light source, which is located within the gas pocket, and the surrounding fluid. Laser light is reflected from the boundary and is detected by the interferometer to obtain the Doppler velocity of the pressure release surface. The pressure incident on the boundary can be determined from the measured velocity, providing information on the incident acoustic pressure.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENT

Figure 1:
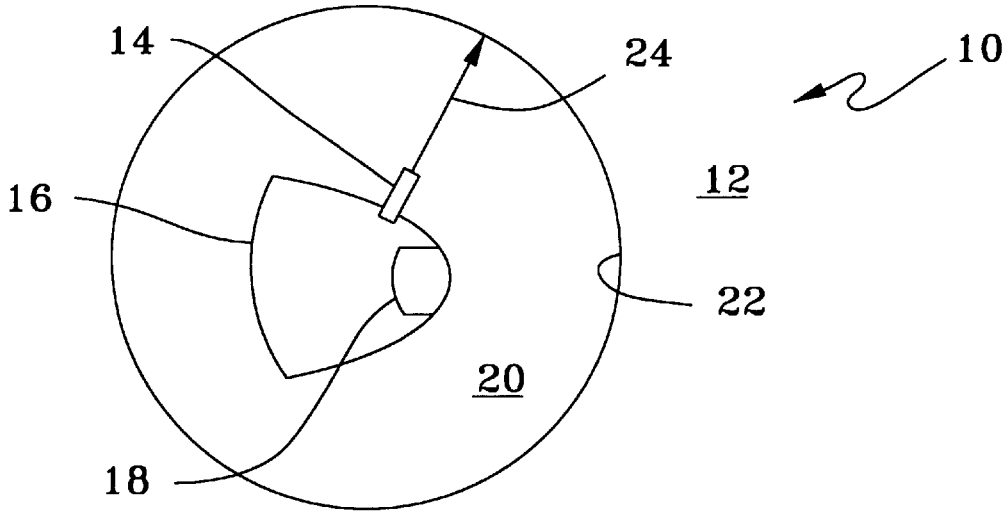
FIG. 1 is a schematic representation of the photon transducer of the present invention.

Referring now to FIG. 1, there is shown a photon transducer system 10 operating in a fluid environment 12. The system 10 includes a laser Doppler interferometer 14 mounted on a platform 16. Platform 16 includes a pressure release surface generator 18. Generator 18 creates a gas bubble 20 about interferometer 14, such that fluid 12 is separated from interferometer 14 by fluid/gas boundary surface 22. The boundary 22 is both acoustically and optically reflective. The acoustic reflectivity is obtained from the acoustic characteristic impedance between the gas and the fluid. The optical reflectivity is due to Fresnel reflection, i.e., due to the refractive index difference between the gas and fluid at the laser wavelength. In operation, the laser beam of interferometer 14 is directed perpendicularly to boundary 22, as indicated by arrow 24. Interferometer 14 operates in the well known manner of laser-based interferometers to determine the Doppler velocity of the boundary. It is contemplated that a red Helium-Neon coherent laser beam will be utilized. As is common to many well known transducer technologies, e.g., the laser optic transducer of Jacobs, the velocity measurements provide information on the acoustic pressure incident on the fluid side of boundary 22.

The invention thus described is a laser based technique for detecting acoustic signals in a fluid, or underwater, environment. A laser-based interferometer is directed perpendicularly at a fluid/gas boundary surface generated by the photon transducer system. Using the light reflected from the surface, the interferometer measures the Doppler velocity of the boundary surface which, in turn, provides information about the incident acoustic pressure on the fluid side of the surface. It can be easily seen that the photon transducer system described can be readily adapted to detect such acoustic signals in a dynamic fluid environment. As with other transducer systems, noise effects caused by the movement will need to be taken into account. Signal processing methods for increasing signal to noise ratios are well known in the art and can be adapted for the photon transducer described herein. By generating an acoustically and optically reflective fluid/gas boundary surface, this device has certain advantages over other laser transducer systems which attempt to discern movement of particles within the fluid. The scattering surface for the inventive device is defined as the fluid/gas boundary, not particles embedded in the fluid. Thus, the operation of the device is not inhibited by the Brownian motion of the particles in the fluid and the refractive index variation and turbulence of the fluid medium. Also, for plane waves of identical sound pressure level acting upon the pressure release boundary and particles within the fluid, the velocity of the pressure release boundary due to the action of the plane wave is twice that of particles within the fluid. The resolution of the acoustic signals is thus improved.

Figure 1A:
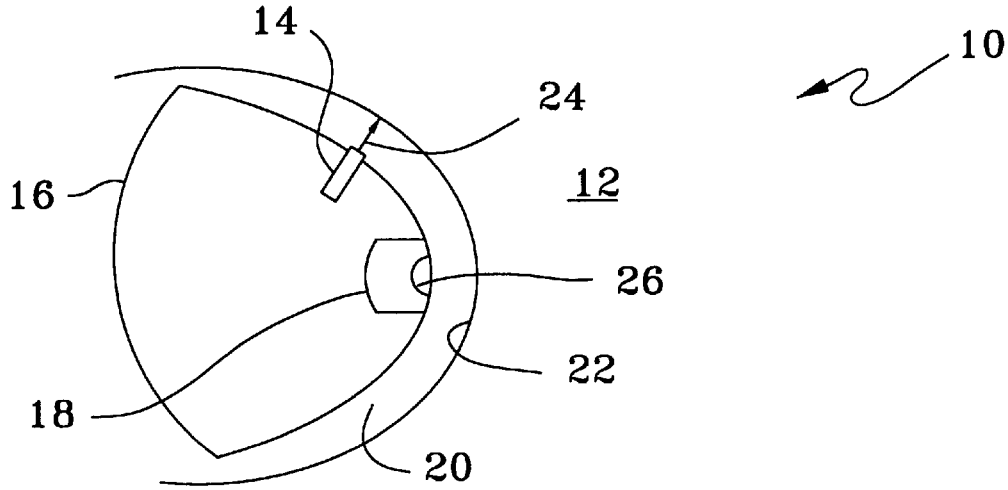
FIG. 1A is a schematic representation of an embodiment of the photon transducer of the present invention having a gas release orifice.
Figure 1B:
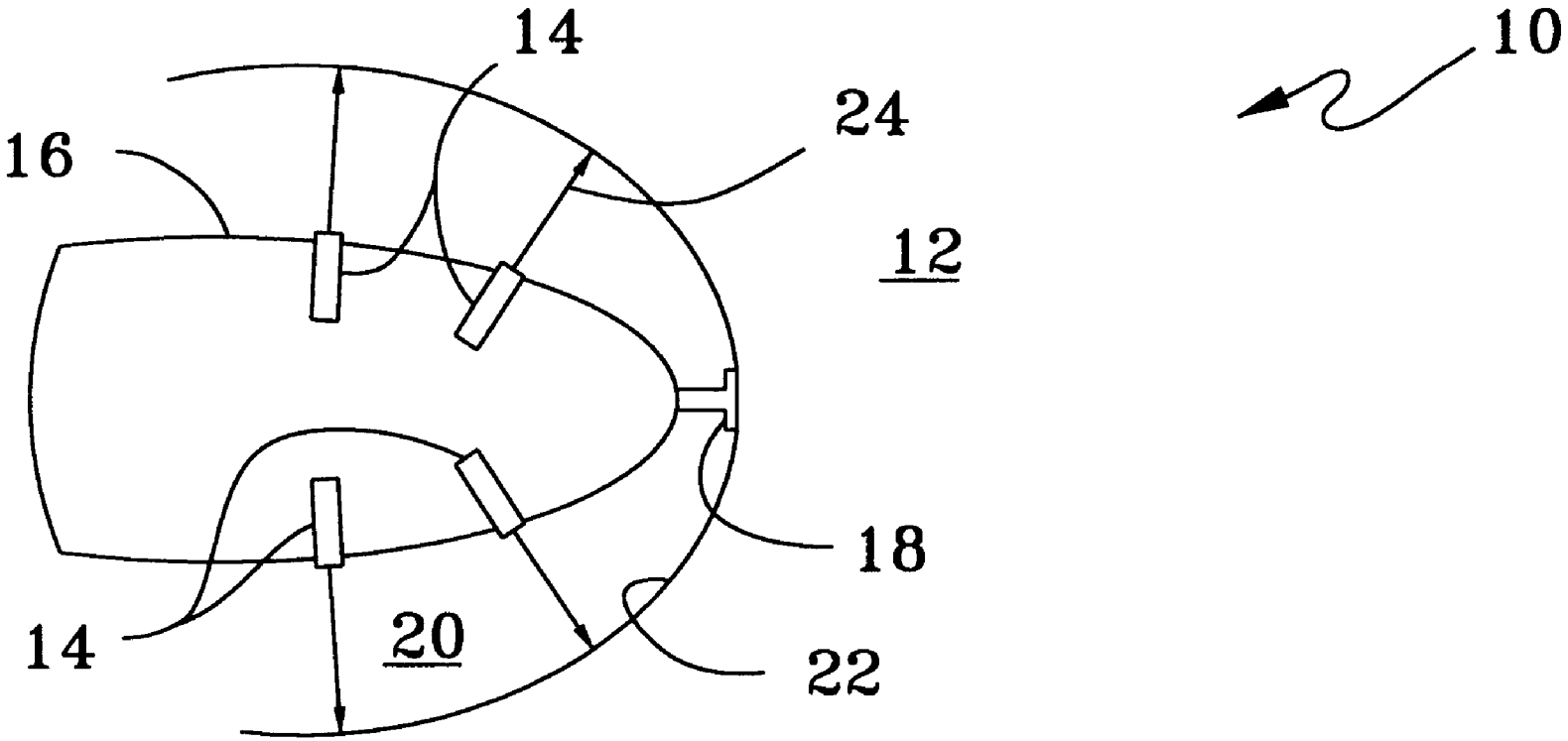
FIG. 1B is a schematic representation of another embodiment of the photon transducer of the present invention for use in a high speed application.

Although the present invention has been described relative to a specific embodiment thereof, it is not so limited. The gas bubble may be generated in a number of manners. For example, FIG. 1A shows generator 18 as having an orifice 26 on platform 16. When platform 16 is moving through the fluid, a suitable gas may be released at orifice 26, which is located upstream of the interferometer 14. As the platform 16 is moved through fluid 12 with sufficient velocity, the gas will be forced backwards over the area of interferometer 14, creating boundary surface 22. In a number of underwater applications, such as when platform 16 is a torpedo, it has been found that drag can be reduced by the introduction of a liquid polymer at the forward end of the torpedo. This polymer drag reduction method could be adapted to incorporate the release of gas from orifice 26. In this manner, the polymer may serve to better confine the gas and provide a smoother boundary surface 22 in the area of interferometer 14. Additionally, if the speed of platform 16 is great enough, generator 18 may be simply an obstruction plate, such as a flat plate, attached to the upstream end of platform 16 as shown in FIG. 1B. As the speed of platform 16 increases, obstruction plate generator 18 will cause a cavity to form over platform 16 and interferometer 14 is placed in the area within this cavity. As with standard acoustic transducers, the photon transducer 10 may incorporate a transducer array. Such an array may provide acoustic signal profiles along boundary surface 22. FIG. 1B also shows four laser interferometers 14 placed about platform 16. As with interferometer 14 of FIGS. 1 and 1A, each interferometer 14 in FIG. 1B is directed perpendicularly to boundary surface 22. As the shape of boundary surface 22 may not be precisely known before operation of the photon transducer system 10, it is anticipated that laser interferometer 14 will incorporate alignment means for directing the laser perpendicularly to the boundary surface 22, such alignment means being well known in the art. For example, the interferometer may sweep out a pattern of pulsed beams against the surface and determine the perpendicular direction from the beam reflection having the minimum return time.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A photon transducer system for detecting acoustic signals within a fluid medium, the system comprising:

a bubble generating means forming a boundary surface between the fluid medium and a gas within the bubble; and a laser interferometer located within the bubble, the interferometer measuring a velocity of the boundary surface by directing a laser beam against the surface and detecting a reflection of the beam, the velocity of the boundary surface corresponding to the acoustic signals.

2. The photon transducer system of claim 1 wherein the laser beam is directed perpendicularly against the surface.

3. The photon transducer system of claim 1 further comprising a platform for mounting the interferometer and the generating means.

4. The photon transducer system of claim 1 wherein the laser interferometer comprises a plurality of laser beams, each beam separately directed at the boundary surface.

5. The photon transducer system of claim 1 wherein the bubble generating means further comprises an orifice for releasing the gas into the fluid medium so as to encompass the interferometer.

6. The photon transducer system of claim 5 wherein the orifice further releases a liquid polymer into the fluid medium, the liquid polymer serving as the boundary layer and further serving to smooth the boundary layer.

7. The photon transducer system of claim 3 wherein the generating means comprises an extension at a forward end of the platform, an action of the extension against the fluid as a result of movement of the platform through the fluid in a forward direction causing cavitation about the forward end of the platform to generate the boundary surface.

8. The photon transducer system of claim 7 wherein the laser beam is directed perpendicularly against the surface.

9. The photon transducer system of claim 7 wherein the laser interferometer comprises a plurality of laser beams, each beam separately directed perpendicularly to the boundary surface.

10. The photon transducer system of claim 7 wherein the interferometer further comprises a beam directing means to align the laser beam perpendicularly to the boundary surface.

11. The photon transducer of claim 10 wherein:

the interferometer directs a pattern of pulsed laser beams at a plurality of points on the boundary surface; and the beam directing means determines the perpendicular direction from the pulsed beam having the greatest reflection.

12. The photon transducer of claim 10 wherein the laser interferometer comprises a plurality of spaced apart laser beams, the beam directing means separately directing each laser beam perpendicularly to the boundary surface.

13. The photon transducer of claim 7 wherein the extension comprises a flat plate cavitator oriented perpendicularly to the direction of motion of the vehicle.

14. A laser-based method for detecting acoustic signals in a fluid environment comprising the steps of:

providing a laser-based Doppler interferometer;

generating a bubble to form a boundary surface between the fluid and the interferometer;

directing a laser beam from the interferometer to the boundary surface;

receiving a reflected laser beam from the surface to measure a Doppler velocity of the boundary surface; and processing the velocity measurement to determine information on the acoustic signals impinging on the boundary surface.

15. The method of claim 14 wherein the boundary creating step further comprises the step of injecting a gas into the fluid to create the boundary.

16. The method of claim 14 wherein the boundary creating step further comprises the steps of:

moving the interferometer through the fluid; and providing a fluid flow obstruction upstream of the interferometer such that the interferometer is within a cavitation boundary formed by an action of the obstruction against the fluid moving past the obstruction.

17. The method of claim 14 wherein the directing step further comprises directing a plurality of laser beams each at separate points of the boundary surface to measure the velocity of the boundary surface at each separate point, the measurements providing a profile of the acoustic signal along the boundary.

18. The method of claim 14 wherein the directing step further comprises the steps of:

directing a series of laser pulses at a plurality of points on the boundary surface;

receiving a reflected pulse from the boundary surface for each of the laser pulses; and directing the laser beam in a direction of the laser pulse having a minimum reflected pulse return time.

* * * * *